US006843475B1

(12) United States Patent
Madsen

(10) Patent No.: US 6,843,475 B1
(45) Date of Patent: Jan. 18, 2005

(54) MEDIA DUPLEXER WITH DISAPPEARING SHEET BARRIER

(75) Inventor: Jeffrey C. Madsen, Eagle, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/615,255

(22) Filed: Jul. 8, 2003

(51) Int. Cl.[7] ..... B65H 29/00
(52) U.S. Cl. ..... 271/186
(58) Field of Search ..... 271/185, 186

(56) References Cited

U.S. PATENT DOCUMENTS 4,486,012 A * 12/1984 Bock et al. ..... 271/3.15
4,512,255 A * 4/1985 Crist ..... 101/230
5,449,164 A * 9/1995 Quesnel et al. ..... 271/186
5,855,367 A * 1/1999 Inoue et al. ..... 271/186
5,887,868 A * 3/1999 Lambert et al. ..... 271/186
6,478,490 B2 * 11/2002 Kelley et al. ..... 400/624
6,719,283 B2 * 4/2004 Tsuchiya et al. ..... 270/58.07

FOREIGN PATENT DOCUMENTS

JP 1275366 A * 6/1989

* cited by examiner

*Primary Examiner*—David H. Bollinger

(57) ABSTRACT

A media duplexer for a printing system is disclosed, the duplexer comprising a sheet barrier within the duplexer suspended between upper and lower belt pulleys, wherein the sheet barrier comprises a belt having at least two barriers separated by at least two openings, and wherein the sheet barrier rotates about the upper and lower belt pulleys, and retractable pinch rollers disposed at an entry to the duplexer, wherein the retractable pinch rollers retract when one of the at least two barriers is rotated near the entry to the duplexer, wherein print media enters and exits the duplexer through the at least two openings.

33 Claims, 6 Drawing Sheets

MEDIA DUPLEXER WITH DISAPPEARING SHEET BARRIER

FIELD OF THE INVENTION

The present invention relates, in general, to media handling devices, and, more specifically, to media duplexers.

DESCRIPTION OF RELATED ART

Media technology has advanced considerably over the last 20 years. One popular feature, found in printing systems is duplex or double-sided printing. Similar features may also be found in scanning devices. Duplex printing or scanning uses a mechanism that can physically turn the substrate or print media over. Once turned over, an image may be placed onto or scanned from the other side of the substrate. A method of accomplishing this task is to divert the substrate down an opening, alley, or slot and then pulling the sheet back out of the slot wherein the former trailing edge is now the leading edge. Typically, a subsequent page waits until the preceding page has completely exited this apparatus before entering. In order to implement this process, a gap or space between successive pieces of paper larger than the length of a page is designed into the duplex system. This page-sized gap generally reduces the performance of the system by half Image fragility typically prevents more than one page to be in the media duplexer at any one time. Accordingly, the aforementioned gap between successive pages is generally, at least, page-sized. In printing processes, image fragility includes issues such as smudging, ink transfer, sheet collisions, static build up, and the like. If two pages were in contact while sliding by each other, print quality would likely suffer due to transfer of ink from one page to the other, smudging the images on either page, having the pages collide, or building up enough static energy to either cause a spark within the printer, potentially damaging it or creating attraction forces on the paper that make it difficult to handle.

BRIEF SUMMARY OF THE INVENTION

Representative embodiments of the present invention are directed to a duplexer for a media handling system, the duplexer comprising a sheet barrier suspended between upper and lower rotation points, wherein the sheet barrier comprises a belt having at least one barrier separated by at least one opening, and wherein the sheet barrier rotates about upper and lower rotation points, and retractable pinch rollers disposed at an entry to the duplexer, wherein the retractable pinch rollers retract when one of the at least one barrier is rotated near the entry to the duplexer, wherein media enters the duplexer through one of the at least one opening.

Additional representative embodiments of the present invention are directed to a method for accommodating two pages in a duplexer at the same time, the duplexer having a rotating barrier disposed therein, the rotating barrier having barrier material separated by an open gap, the method comprising pushing a current page into an exit path from the duplexer through one of the open gaps, directing a next page into an input path, rotating the barrier material between the next page entering the duplexer and the current page exiting the duplexer, wherein the one of the open gaps is positioned to allow the current page to exit the duplexer, pulling the current page completely from the duplexer, and rotating another of the open gaps into a position opening the exit path to the next page.

Further representative embodiments of the present invention are directed to a system for a changing media orientation in a media handling system, the system having a revolving obstructer disposed therein, the revolving obstructer having at least one opening therein, the system comprising means for directing a media page within the system to an exit path through one of the at least one opening, means for rotating the barrier material between a next page entering the system and the current page exiting the system, wherein one of the at least one opening is positioned to allow the current page to exit the system, means for pulling the current page completely from the system, and means for rotating the at least one opening into a position exposing the exit path to the next page.

DETAILED DESCRIPTION

A barrier is disclosed that protects a page of media leaving a duplexer from being damaged or smeared by a subsequent page entering the duplexer at the same time. Additionally, or alternatively, the barrier protects the subsequent page. The barrier is in the form of a belt or sheet which may comprise a smooth film, or other such element, which, by virtue of its geometry and motion, repeatedly presents itself between the entering and exiting pages or media when contact between those pages would otherwise be inevitable. The coexistence of media in the duplexer enables increased performance over mechanisms that must increase page to page gaps to avoid collisions. This feature allows the gap between successive pages to be less than one page length, allowing better system performance. Successive pages may coexist in a duplexing slot without colliding with, smearing, or otherwise threatening the image quality of each other.

It should be noted that such a duplexer may be used within a printer, a scanner, a fax, or other kind of printing or multifunction device. The present invention is not limited to solely a printer.

Figure 1A:
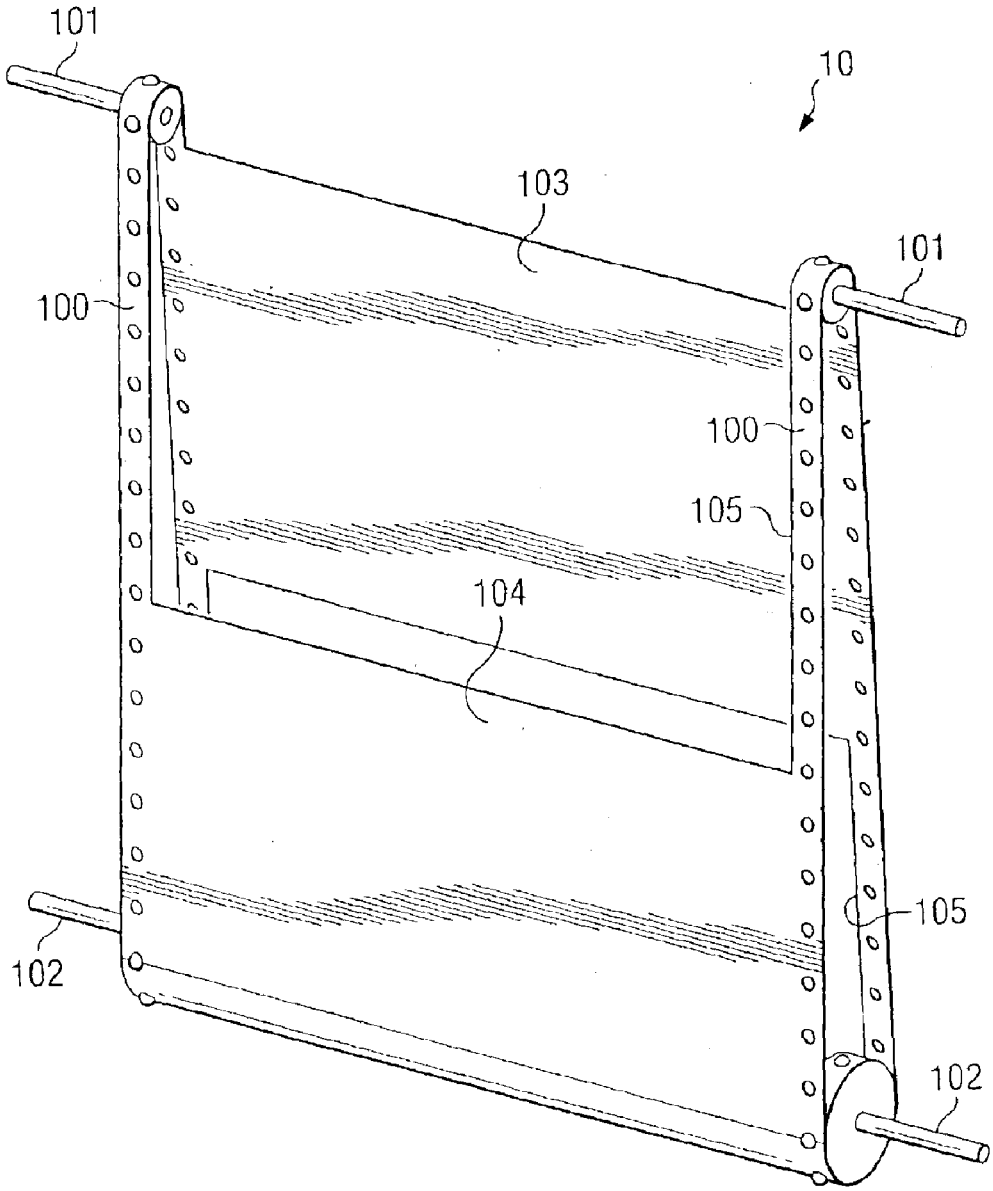
FIG. 1A is a perspective diagram illustrating a sheet barrier configured according to one embodiment of the present invention within a duplexing system.

FIG. 1A is a diagram illustrating sheet barrier 10 configured according to one embodiment of the present invention within a duplexing system. Sheet barrier 10 includes tracks 100 that fit around upper belt pulleys 101 and lower belt pulleys 102. Sheet barrier 10 comprises sheet 103 and sheet 104 which are bounded on both sides by opening 105. As upper belt pulleys 101 and lower belt pulleys 102 rotate, sheet barrier 10 revolves alternating placement of sheets 103 and 104 and openings 105.

Tracks 100 and upper and lower belt pulleys 101 and 102 may comprise a tractor drive as illustrated in FIG. 1A, or may also comprise any other means for running sheet barrier 10 around upper and lower belt pulleys 101 and 102, such as by a belt drive or other friction mechanism.

Figure 1B:
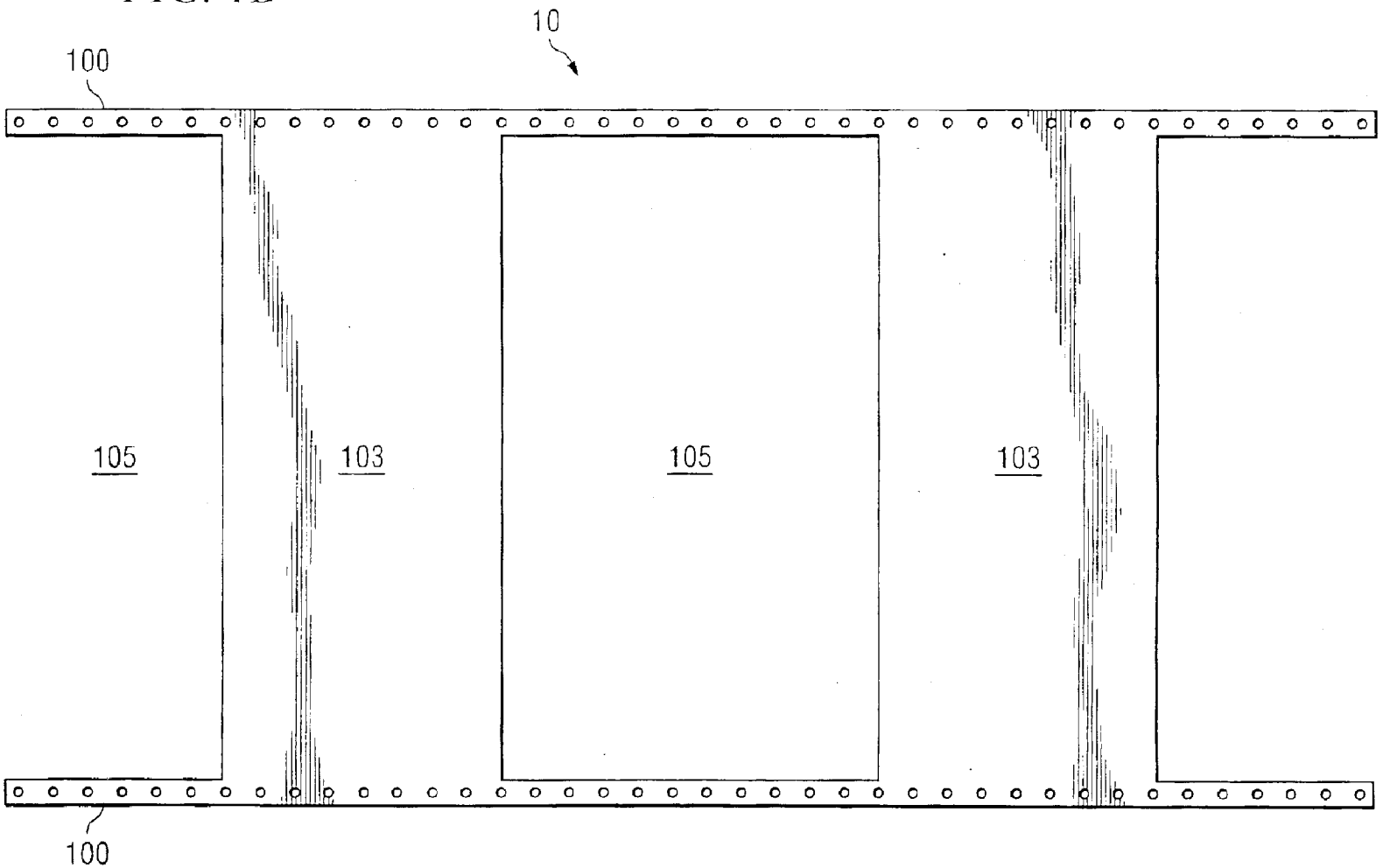
FIG. 1B is a diagram detailing the sheet barrier, as shown in FIG. 1B, and configured according to an embodiment of the present invention laid out in a flat orientation.

FIG. 1B is a diagram detailing sheet barrier 10, and configured according to an embodiment of the present invention laid out in a flat orientation. Sheet barrier 10 is shown with tracks 100 unattached to illustrate the layout of openings 105 alternating with sheets 103 and 104 (104 not shown in FIG. 1B).

The elements shown in FIGS. 1A and 1B introduces a "barrier" (in the form of sheets 103 and 104 of sheet barrier 10) designed to be positioned between a page that is entering and a page that is exiting the duplexer, and then effectively disappear each time a page reaches the turnaround point. The "disappearance" allows a page to exit the duplexer but then reappear on the opposite side of the exiting page to protect it from the entering page. The "disappearance" is accomplished in the illustrated embodiment by virtue of openings 105 in sheet barrier 10, and upper belt pulleys 101, which are not connected by a cross shaft (i.e., are supported only on the outside).

When a page of media begins to enter the duplexer, it first encounters the material of either of sheets 103 and 104, which forms a barrier between the entering page and an exiting page. The entering page continues downward and soon encounters one of openings 105, through which it enters. Before the page has reached the bottom of the duplexer, the other one of sheets 103 and 104 begins to rise up along the backside of the page. This segment of belt material of either of sheets 103 and 104 will then protect the page from the next entering page.

The belt material may be chosen to interact favorably with the imaging agent, without causing smearing. Such a material may include a film of polyamide, a textile/fabric, or even some form or polymer or rubber. The material may be selected to have anti-static properties as well as a characteristic that would inhibit ink from adhering to the surface to cause smearing or streaking. Additionally, the material selected for sheet barrier 10 in certain embodiments of the invention provides a flexible belt or sheet that is still stiff enough to hold itself rigid across its width. The width would preferably be great enough to allow the windows or openings 105 in sheet barrier 10 to be wider than the widest-allowed print media.

The length of sheet barrier 10 may be set at any various number of lengths responsive to several criteria that should be considered for proper operation. A first consideration is that sheet barrier 10 should generally reach a pair of media engaging and driving surfaces provided by retractable pinch roller 21 (FIG. 2A) after the leading edge of the exiting sheet has been engaged by exit pinch roller 22 (FIG. 2B) and after retractable pinch roller 21 (FIG. 2C) has opened. Another consideration is that sheet barrier 10 should generally clear retractable pinch roller 21 (FIG. 2A) before the trailing edge of a sheet entering the duplexer has reached and is no longer engaged by entry pinch roller 20 (FIG. 2B) and before retractable pinch roller 21 close onto and engage the entering sheet.

Still another length consideration may be that sheet barrier 10 should generally be long enough so that the leading edge of the entering sheet does not touch the exiting sheet. Furthermore, sheet barrier 10 should generally be long enough such that the longest compatible substrate may be held by retractable pinch roller 21 at its furthest reach into the duplexer without the free end of the substrate touching lower pulley system 102.

In addition to width and length considerations, the speed of sheet barrier 10 is an element that should generally be considered. Sheet barrier 10, which typically rotates upward toward the input side of the duplexer to "scoop up" incoming sheets, should generally rotate at a speed such that sheets 103 and 104 and/or openings 105 generally reaches the same position in a cyclic pattern. The length of the frequency pattern should generally be equivalent with the cycle of the substrates entering and leaving the duplexer. Speed considerations may generally be influenced by the size and number of sheets and/or the size and number of openings. Furthermore, sheet barrier 10 should generally not be so fast that it creates an undesirable aerodynamic effect on either of the entering or exiting substrates.

Figure 2A:
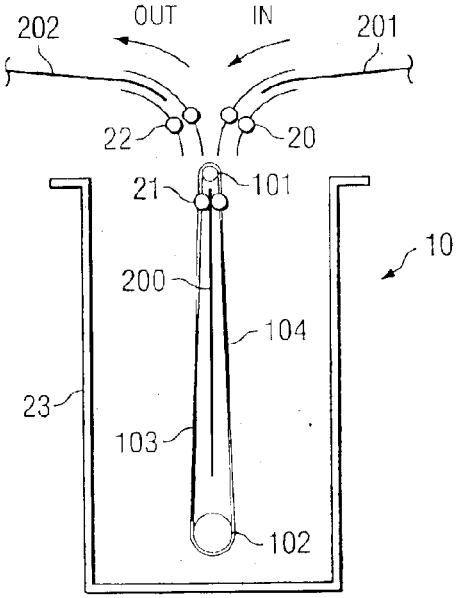
FIGS. 2A–2H are a series of diagrams illustrating the positional states of the sheet barrier, as shown in FIG. 1A and configured according to an embodiment of the present invention, during operation.

FIGS. 2A–2H are a series of diagrams illustrating the positional states of sheet barrier 10, as shown in FIG. 1A and configured according to an embodiment of the present invention, during operation. FIGS. 2A–2H illustrate sheet barrier 10 from a side view as installed for operation in printer duplexer 23. FIG. 2A illustrates page 200 at the lowest point within duplexer 23. At this point, page 200 is held by retractable pinch rollers 21, which reverse direction to begin pulling page 200 out of duplexer 23. Incoming page 201 is being fed into duplexer 23 by entry pinch rollers 20, while outgoing page 202 is being removed from the duplexing system by exit pinch rollers 22. Sheet barrier 10 is shown with sheets 103 and 104 rotating about lower belt pulleys 102 and upper belt pulleys (not shown in FIG. 2).

Figure 2B:
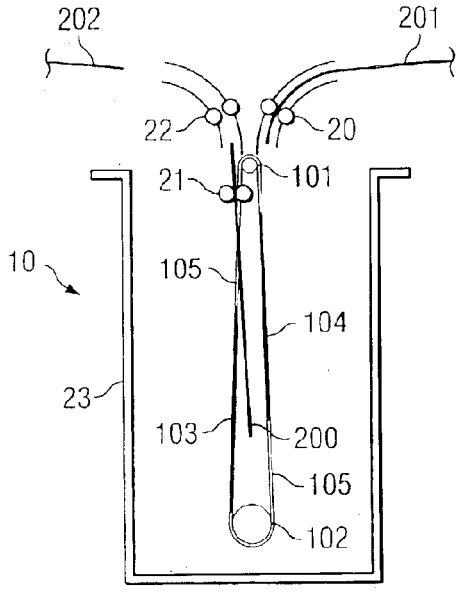

FIG. 2B illustrates retractable pinch rollers 21 shifting into an exit position to direct page 200 into exit pinch rollers 22. Sheets 103 and 104 continue to rotate with one of openings 105 allowing page 200 to exit duplexer 23. Sheet 202 is shown exiting the system.

Figure 2C:
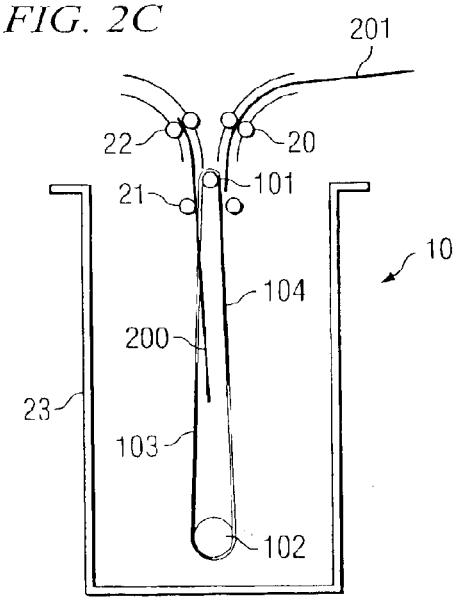

FIG. 2C shows retractable pinch rollers 21 retracting to allow sheet 104 to approach upper belt pulleys 101 (FIG. 1). Page 200 has engaged exit pinch rollers 22, which allows retractable pinch rollers 21 to retract. If retractable pinch rollers 21 were not to retract, sheet 104 would likely collide with it, ceasing the process.

Figure 2D:
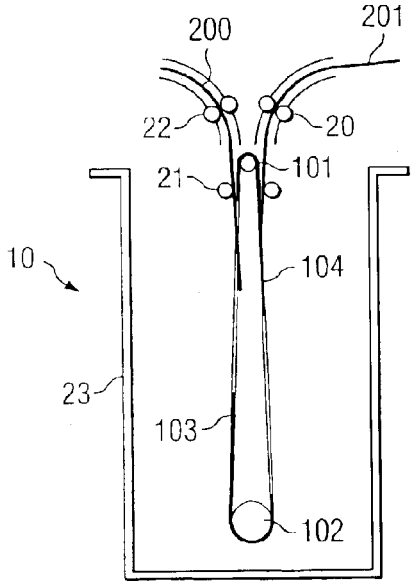

FIG. 2D shows sheet 104 providing a barrier between page 200, exiting duplexer 23, and page 201 just entering duplexer 23. Entry pinch rollers 20 continue directing page 201 into duplexer 23 while exit pinch rollers 22 continue pulling page 200 from duplexer 23. Sheet 104 begins to turn around upper belt pulleys 101 (FIG. 1), while sheet 103 begins to turn around lower belt pulley 102.

Figure 2E:
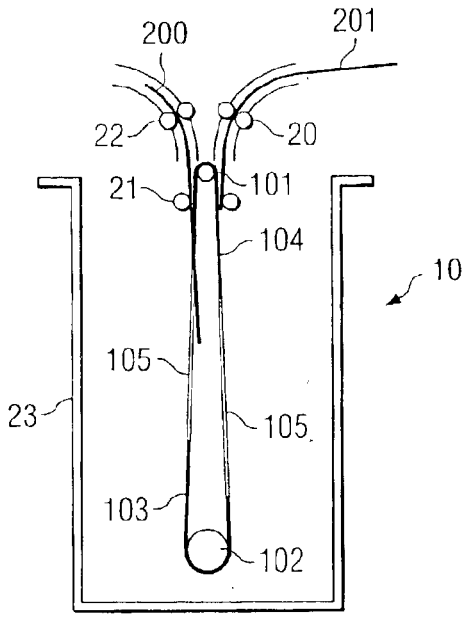

FIG. 2E shows sheets 103 and 104 continuing their turns, while page 200 exits duplexer 23 pulled by exit pinch rollers 22, and page 201 enters duplexer 23 pushed by entry pinch rollers 20. Sheet 104 maintains itself as a barrier between pages 200 and 201. One of opening 105 is moving up toward upper belt pulleys 101 (FIG. 1).

Figure 2F:
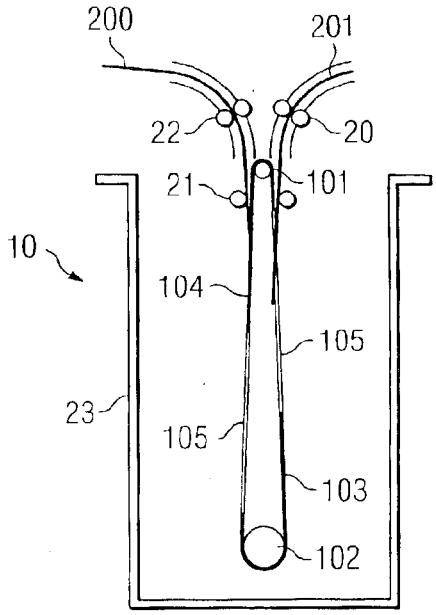

FIG. 2F shows page 201 entering duplexer 23 through opening 105 between sheet 104 and sheet 103 turning around lower belt pulley 102. Retractable pinch rollers 21 remain open as sheet 104 continues to revolve around upper belt pulleys 101 (FIG. 1). While retractable pinch rollers 21 are in an open position, entry pinch rollers 20 continue pushing paper 201 into duplexer 23. Sheet 104 remains a barrier between page 201 and page 200 being pulled out by exit pinch rollers 22.

Figure 2G:
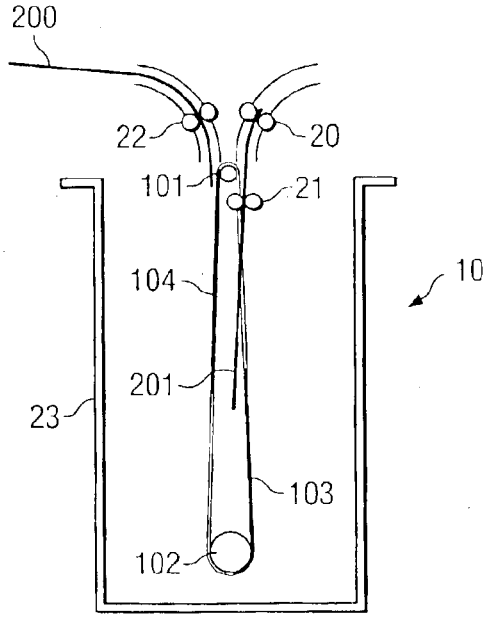

FIG. 2G shows retractable pinch rollers 21 snapping back to a pinch and also moving to the entry position around page 201 as soon as practical after sheet 104 clears retractable pinch rollers 21. Retractable pinch rollers 21 then assist in directing page 201 further into duplexer 23. Sheet 103 rises behind page 201 in order to provide a barrier against the subsequent pages. Page 201 is essentially captured or contained between sheets 103 and 104 as it enters further into duplexer 23. Page 200 continues to be moved out of duplexer 23 by exit pinch rollers 22.

Figure 2H:
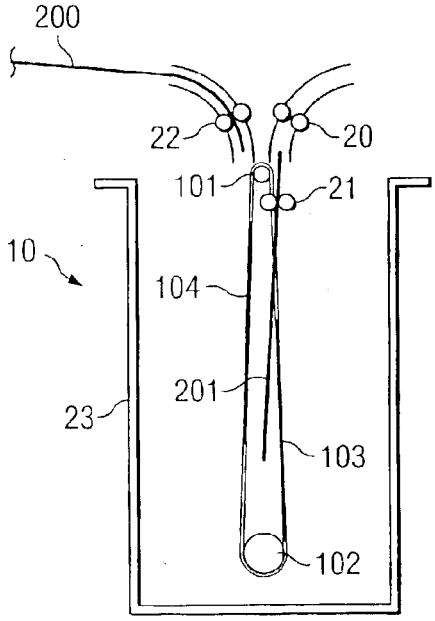

FIG. 2H shows page 201 being held and directed by retractable pinch rollers 21 only. The trailing edge of page 201 has exited entry pinch rollers 20. Sheets 103 and 104 are containing page 201 within duplexer 23 while exit pinch roller 22 has almost completely directed page 200 from duplexer 23. As page 201 reaches the lowest point within duplexer 23, retractable pinch rollers 21 reverse direction and move to the exit position again, as was illustrated and described in FIGS. 2A and 2B. The reversal of retractable pinch roller 21 begins the exit procedure for page 201 as a new page begins its entry.

In order to accommodate transportation of the paper or media after its trailing edge has left the pinch rollers of the entering path and before the same edge (now the leading edge) has entered the first pinch rollers of the exiting path, a set of otherwise retracted pinch rollers near the top of the duplexer (retractable pinch rollers 21 of FIG. 2) close and provide the remaining downward and subsequent upward travel into the new path. The timing of the closing and opening of this pinch roller is set for these pinch rollers to be closed when the belt window or opening is present at the retractable pinch roller location. This configuration allows the media to enter and exit the duplexer, yet provides the barrier for the entering and exiting media when those media are being controlled by the entering and exiting pinch rollers. The various embodiments of the duplexer sheet barrier as described herein allow simultaneous entry and exit of separate sheets into the duplexing mechanism without sheet-to-sheet contact (and associated damage or smearing, etc.), by providing a barrier between the entering and exiting sheets.

Figure 3:
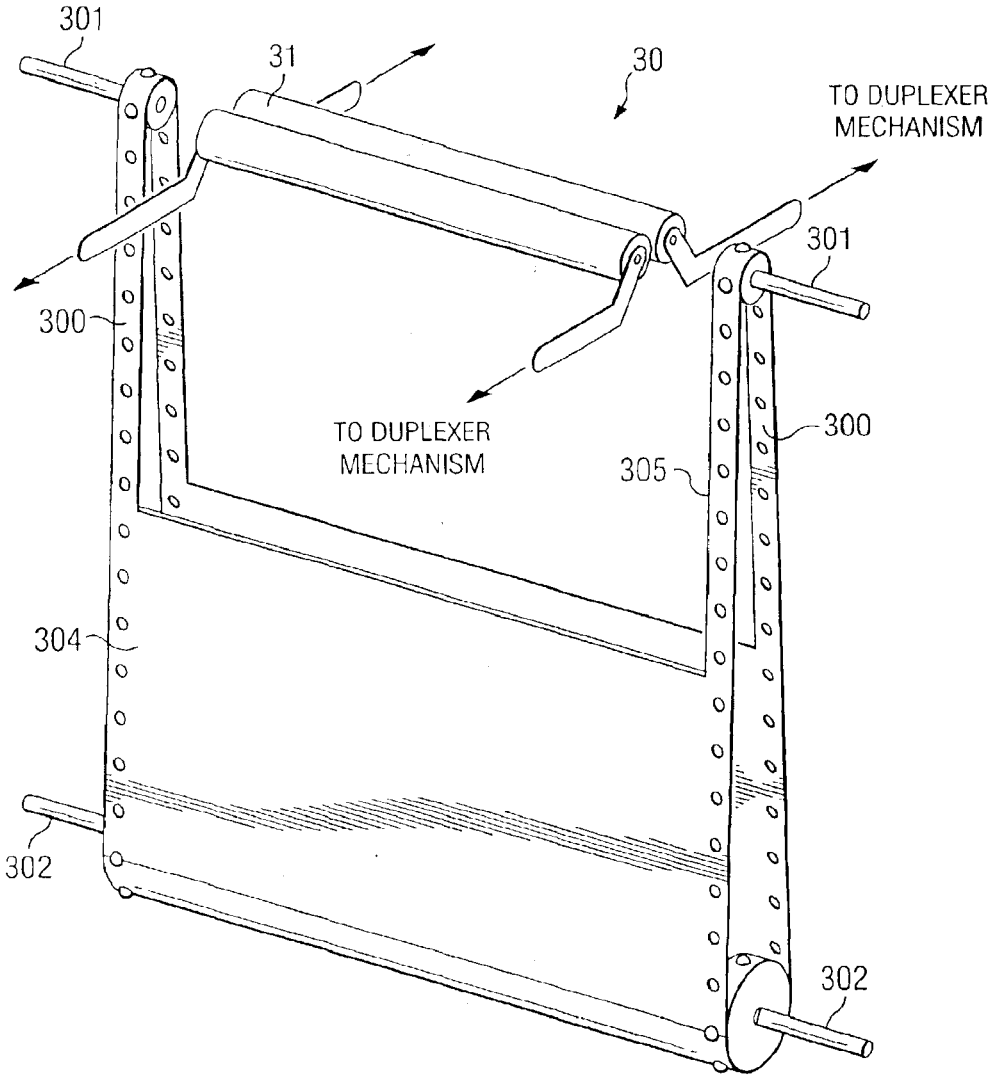
FIG. 3 is a perspective diagram illustrating a barrier system configured according to another embodiment of the present invention having one barrier and one opening.

Although FIG. 2 illustrates sheet barrier 10 having two barriers and two openings, other numbers of barriers and openings may be used. FIG. 3 is a perspective diagram illustrating barrier system 30 configured according to another embodiment of the present invention having one barrier 304 and one opening 305. FIG. 3 illustrates barrier system 30 having tracks 300 that fit around upper pulleys 301 and lower pulleys 302. Barrier system 30 comprises barrier 304 and opening 305. As upper pulleys 301 and lower pulleys 302 rotate, barrier system 30 revolves causing barrier 304 and opening 305 to alternate positions in a cyclic fashion.

Figure 4:
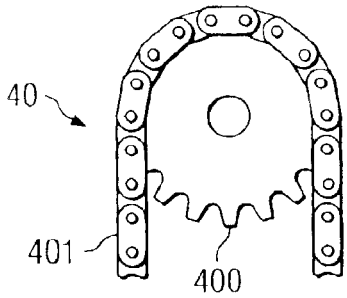
FIG. 4 is a side-view of a chain drive operable with various embodiments of the present invention.

In additional embodiments of the duplexer barrier system described herein, different drive systems for rotating the barrier system. FIG. 4 is a side-view of chain drive 40 operable with various embodiments of the present invention. The barriers and openings would be rotated by moving cog 400 which engages and moves chain 401.

Figure 5A:
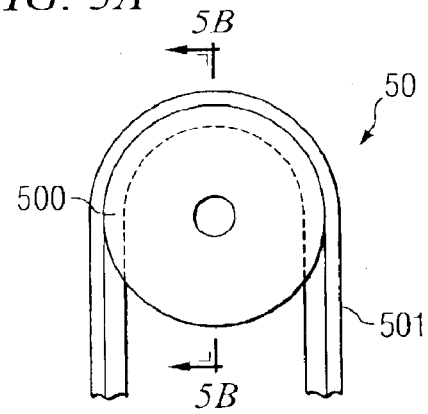
FIG. 5A is a side-view of a slotted belt drive operable with various embodiments of the present invention.

FIG. 5A is a side-view of slotted belt drive 50 operable with various embodiments of the present invention.

Figure 5B:
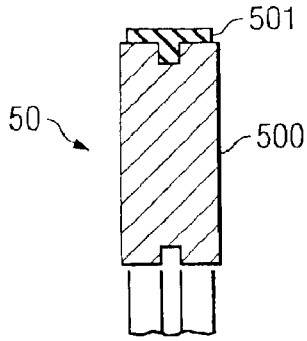
FIG. 5B is a cross-sectional view of a slotted belt drive operable with various embodiments of the present invention showing a belt and a slotted pulley.

FIG. 5B is a cross-sectional view of slotted belt drive 50 operable with various embodiments of the present invention showing belt 500 and slotted pulley 501. The barriers and openings are rotated around slotted pulley 501 with the extrusion on belt 500 inserts into the slot in slotted pulley 501. This joint assists maintaining a lateral position of the barrier system.

Figure 6:
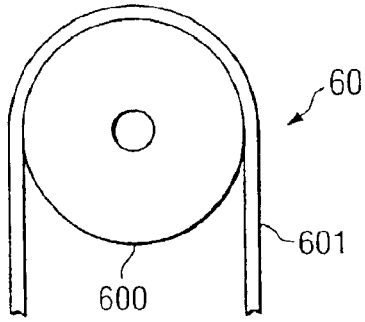
FIG. 6 is a side-view illustrating a friction drive for a barrier system operable with various embodiments of the present invention.

FIG. 6 is a side-view illustrating friction drive for a barrier system operable with various embodiments of the present invention. Belt 600 sits on top of roller 601 with the friction between the two elements allows belt 600 to move when roller 601 is rotated. Other different types of drive systems may also be used in the embodiments of the barrier system described herein.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A duplexer for a media handling system, said duplexer comprising:

a sheet barrier suspended between upper and lower rotation points, wherein said sheet barrier comprises a belt having at least one barrier separated by at least one opening, and wherein said sheet barrier is configured to rotate about said upper and lower rotation points; and retractable pinch rollers disposed at an entry to said duplexer, wherein said retractable pinch rollers retract when one of said at least one barrier is rotated near said entry to said duplexer, wherein media enters said duplexer through one of said at least one opening.

2. The media duplexer of claim 1 further comprising entry and exit pinch rollers, wherein, when said retractable pinch rollers are retracted, said entry pinch rollers hold said print media entering said duplexer and said exit pinch rollers hold said print media exiting said duplexer.

3. The media duplexer of claim 1 wherein said retractable pinch rollers are movable into an entry position to accept said print media entering said duplexer.

4. The media duplexer of claim 1 wherein said retractable pinch rollers are movable into an exit position to expel said print media exiting said duplexer.

5. The media duplexer of claim 1 wherein said upper and lower belt pulleys rotate said sheet barrier using one of:

a tractor drive;

a chain drive;

a slotted belt drive; and a fiction belt drive.

6. The media duplexer of claim 1 wherein said media handling system comprises one or more of a printer, a scanner, a fax, and a multifunction device.

7. The media duplexer of claim 1 wherein said barrier material comprises at least one of:

polyamide;

fabric;

plastic; and rubber.

8. The media duplexer of claim 7 wherein said barrier material exhibits one or more of:

anti-static property;

non-stick property;

rigidity across a width of said sheet barrier; and flexibility.

9. The media duplexer of claim 1 wherein said print media exits said duplexer thru one of said at least one opening.

10. A method for accommodating two pages in a duplexer at the same time, said duplexer having a rotating barrier disposed therein, said rotating barrier having barrier material separated by open gaps, said method comprising:

pushing a current page into an exit path from said duplexer through one of said open gaps;

directing a next page into an input path;

rotating said barrier material between said next page entering said duplexer and said current page exiting said duplexer, wherein said one of said open gaps is positioned to allow said current page to exit said duplexer;

pulling said current page completely from said duplexer; and rotating another of said open gaps into a position opening said exit path to said next page.

11. The method of claim 10 further comprising:

pushing said next page into said exit path.

12. The method of claim 10 further comprising:

retracting a set of retractable pinch rollers within said duplexer when said barrier material is rotated between said next page and said current page.

13. The method of claim 12 further comprising:

pinching said set of retractable pinch rollers when said open gaps are rotated.

14. The method of claim 12 further comprising:

reversing a direction of said set of retractable pinch rollers to change said direction of one or more of said current page and said next page.

15. The method of claim 12 further comprising:

shifting said set of retractable pinch rollers to an output position to expel said current page; and shifting said set of retractable pinch rollers to an input position to accept said next page into said duplexer.

16. A system for a changing media orientation in a media handling system, said system having a revolving obstructer disposed therein, said revolving obstructer having at least one opening therein, said system comprising:

mean for directing a media page within said system to an exit path through one of said at least one opening;

means for rotating said barrier material between a next page entering said system and said current page exiting said system, wherein one of said at least one opening is positioned to allow said current page to exit said system;

means for pulling said current page completely from said system; and means for rotating said at least one opening into a position exposing said exit path to said next page.

17. The system of claim 16 further comprising:

means for pushing said next page into said exit path.

18. The system of claim 16 further comprising:

means for retracting a set of retractable pinch rollers within said system when said barrier material is rotated between said next page and said current page.

19. The system of claim 18 further comprising:

means for pinching said set of retractable pinch rollers when said at least one opening is rotated.

20. The system of claim 18 further comprising:

means for reversing a direction of said set of retractable pinch rollers to change said direction of one or more of said current page and said next page.

21. The system of claim 18 further comprising:

means for shifting said set of retractable pinch rollers to an output position to expel said current page; and means for shifting said set of retractable pinch rollers to an input position to accept said next page into said system.

22. The system of claim 16 wherein said media handling system comprises one of a printer, a scanner, a fax, and a multifunction unit.

23. A media handling system comprising:

a first media drive surface;

a second media drive surface; and a first barrier movable between a first position in which the first barrier is adapted to extend between a first sheet and a second sheet while the first sheet and the second sheet are simultaneously received between the first media driving surface and the second media driving surface and a second position in which the first barrier is removed from between the first sheet and the second sheet.

24. The system of claim 23 wherein the barrier rotates about axes between the first position and the second position.

25. The system of claim 23 wherein the first media driving surface and the second media driving surface comprise rollers.

26. The system of claim 23 wherein the first media driving surface and the second media driving surface are movable between a first state in which the surfaces pinch one of the first sheet and the second sheet therebetween and a second state in which the surfaces are spaced apart to simultaneously receive the first sheet and the second sheet.

27. The system of claim 23 including a second barrier movable between a third position in which the second barrier is adapted to extend between the second sheet and a third sheet while the second sheet and the third sheet are simultaneously received between the first media driving surface and the second media driving surface and a second position in which the second barrier is removed from between the second sheet and the third sheet.

28. The system of claim 27 including a belt providing the first barrier and the second barrier, wherein the first barrier and the second barrier are separated by a first gap and a second gap.

29. The system of claim 23 including a belt providing the first barrier, the belt including a gap adjacent the first barrier.

30. A duplexing method comprising:

moving a first sheet of media in a first direction while between a first media driving surface and a second media driving surface;

moving the first sheet of media in a second opposite direction while between the first media driving surface and the second media driving surface;

moving a second sheet of media in the first direction while between the first media driving surface and the second media driving surface; and moving a barrier between a first position in which the barrier is between the first sheet and the second sheet while the first sheet and the second sheet are simultaneously received between the first media driving surface and the second driving surface and a second position in which the barrier is removed from between the first sheet and the second sheet.

31. The method of claim 30 including rotating the barrier around a rotation point.

32. The method of claim 31 wherein the barrier forms first and second portions opposite one another on opposite sides of the rotation point and between the first media driving surface and the second media driving surface.

33. The method of claim 31 wherein rotating the barrier includes rotating a belt providing the barrier and having a gap adjacent the barrier and wherein the gap receives the second sheet while the barrier is between the first sheet and the second sheet.

* * * * *

UNITED STATES PATENT AND TRADEMARK OFFICE

CERTIFICATE OF CORRECTION

PATENT NO. : 6,843,475 B1
DATED : January 18, 2005
INVENTOR(S) : Jeffrey C. Madsen It is certified that error appears in the above-identified patent and that said Letters Patent is hereby corrected as shown below:

Column 1,
Line 26, after "half" insert -- . --.

Column 7,
Line 57, delete "mean" and insert therefor -- means --.

Signed and Sealed this

Eighth Day of November, 2005

JON W. DUDAS
*Director of the United States Patent and Trademark Office*